US010947684B1

(12) United States Patent
Paulin et al.

(10) Patent No.: US 10,947,684 B1
(45) Date of Patent: Mar. 16, 2021

(54) SYSTEM, METHOD AND APPARATUS FOR SECURING A TRAFFIC DELINEATOR

(71) Applicant: Valmont Industries, Inc., Omaha, NE (US)

(72) Inventors: Robert Paulin, Irmo, SC (US); Eric Haddad, Chapin, SC (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 16/785,824

(22) Filed: Feb. 10, 2020

Related U.S. Application Data

(60) Provisional application No. 62/806,074, filed on Feb. 15, 2019.

(51) Int. Cl.
*E01F 9/658* (2016.01)
*E01F 13/02* (2006.01)
*E01F 9/646* (2016.01)

(52) U.S. Cl.
CPC ..... *E01F 13/026* (2013.01); *E01F 9/658* (2016.02); *E01F 9/646* (2016.02)

(58) Field of Classification Search
CPC . E02F 9/623; E02F 9/646; E02F 9/658; E02F 9/677; E02F 13/026
USPC ..... 40/607.1; 403/182, 183, 383
See application file for complete search history.

(56) References Cited

U.S. PATENT DOCUMENTS 1,828,306 A 10/1931 Austin
3,119,588 A * 1/1964 Keats ..... G09F 17/00 248/158
3,672,636 A 6/1972 Parsen
3,728,661 A 4/1973 Kassabgi
4,134,222 A * 1/1979 Orsos ..... G09F 7/20 248/484
4,240,766 A * 12/1980 Smith ..... E01F 9/677 248/160
4,691,818 A * 9/1987 Weber ..... B65G 33/32 198/666
5,524,869 A 6/1996 Asplin
5,727,777 A 3/1998 Chikiri et al.
5,967,693 A * 10/1999 Braaten ..... E21B 17/03 403/383
5,979,880 A 11/1999 Chikiri et al.
6,517,052 B1 2/2003 Lake
(Continued)

FOREIGN PATENT DOCUMENTS

JP H01315214 A 12/1989
JP H10178721 A 6/1998
(Continued)

*Primary Examiner* — Gary S Hartmann
(74) *Attorney, Agent, or Firm* — Milligan PC LLO

(57) ABSTRACT

A delineator mounting system that includes an octagonal mounting apparatus for mating a traffic delineator to an in-ground mount. According to a first preferred embodiment, an exemplary delineator mounting system of the present invention includes an extended central housing having a lower end with an octagonal outer surface, an octagonal inner surface and a flared lower connecting surface. According to a further preferred embodiment, the extended central housing further includes an upper end having a cylindrical main body which includes an upper end exterior surface, an upper end interior surface, and a flared upper connecting surface.

7 Claims, 8 Drawing Sheets

(56) References Cited

U.S. PATENT DOCUMENTS

| | | | | |
|---|---|---|---|---|
| 6,868,641 | B2 * | 3/2005 | Conner | E01F 9/635 52/165 |
| 7,207,400 | B2 * | 4/2007 | Bise | E21B 17/03 175/320 |
| 7,543,365 | B2 * | 6/2009 | Van Mill | F16D 1/108 29/407.02 |
| 7,722,286 | B2 | 5/2010 | Heald | |
| 2009/0065750 | A1 | 3/2009 | Theisen | |
| 2015/0000104 | A1 | 1/2015 | DePue | |

FOREIGN PATENT DOCUMENTS

| | | | |
|---|---|---|---|
| JP | H11187526 | A | 7/1999 |
| JP | 2012217300 | A | 11/2012 |

* cited by examiner

SYSTEM, METHOD AND APPARATUS FOR SECURING A TRAFFIC DELINEATOR

RELATED APPLICATIONS

The present application claims priority to U.S. Provisional Application No. 62/806,074 filed Feb. 15, 2019.

BACKGROUND AND FIELD OF THE PRESENT INVENTION

Field of the Present Invention

The present invention relates generally to a system for securing a traffic delineator. More specifically, the present invention relates to a system, method and apparatus for providing an improved mounting apparatus for securing traffic delineators to delineator mounts.

Background of the Invention

Traffic delineators ("delineators") are a type of pavement marker which are vertically aligned pylons or posts mounted onto a road surface. Delineators are used to channelize traffic by acting as visual guides and typically include one or more reflective strips. Further they can act as obstacles for out-of-control or drifting vehicles and are generally tall enough to impact not only a vehicle's tires but also the vehicle body itself.

Delineators are designed to be rugged, inexpensive and simple to install. They must also be able to survive impacts from vehicles without being pulled from connection with the road surface. At the same time, delineators must be easy to install especially along busy highways where the installers are exposed to high speed traffic.

Known delineators require mounting onto a device that is driven into the ground to receive the delineator and hold it in an upright position. Fasteners are then commonly used to attach the delineator to the in-ground mount and to secure the delineator in an upright position. Examples of modern delineators include delineators which are cylindrical for ease of manufacture, such as those shown in U.S. Pat. No. 7,179,016. Other mounting systems (such as disclosed in U.S. Pat. No. 7,003,919) include perforated square tubing that is driven into the ground. Other designs use adapters which allow cylindrical tubular delineators to be mounted onto a square mounting tube such as those disclosed in U.S. Pat. No. 7,722,286.

Know delineator mounting systems are prone to rotation, leaning, tilting and loosening due to vehicle impacts and weather conditions such as wind, ice, temperature changes. Accordingly, there is a need for an improved delineator mounting system that provides better stabilization while keeping installation time and maintenance low.

SUMMARY OF THE INVENTION

To minimize the limitations found in the prior art, and to minimize other limitations that will be apparent upon the reading of the specifications, the present invention provides a delineator mounting system that includes an octagonal mounting apparatus for mating a traffic delineator to an in-ground mount.

According to a first preferred embodiment, an exemplary delineator mounting system of the present invention includes an extended central housing having a lower end with an octagonal outer surface, an octagonal inner surface and a flared lower connecting surface. According to a further preferred embodiment, the extended central housing preferably further includes an upper end having a cylindrical main body which includes an upper end exterior surface, an upper end interior surface, and a flared upper connecting surface.

According to a further preferred embodiment, the extended central housing preferably further includes a central flange which is connected to the flared lower connecting surface and the flared upper connecting surface.

DETAILED DESCRIPTION OF THE PREFERRED EMBODIMENTS

Reference is now made in detail to the exemplary embodiments of the invention, examples of which are illustrated in the accompanying drawings. Wherever possible, the same reference numbers will be used throughout the drawings to refer to the same or like parts. The description, embodiments and figures are not to be taken as limiting the scope of the claims. It should also be understood that throughout this disclosure, unless logically required to be otherwise, where a process or method is shown or described, the steps of the method may be performed in any order, repetitively, iteratively or simultaneously. As used throughout this application, the word "may" is used in a permissive sense (i.e., meaning "having the potential to'), rather than the mandatory sense (i.e. meaning "must").

Additionally, any examples or illustrations given herein are not to be regarded in any way as restrictions on, limits to, or express definitions of, any term or terms with which they are utilized. Instead, these examples or illustrations are to be regarded as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

With reference now to FIGS. 1-7, the present invention teaches a system, method and apparatus which includes an improved mounting apparatus for securing traffic delineators to delineator mounts. As should be understood, the examples discussed herein are intended to be illustrative and any of a variety of alternative systems, embodiments and/or configurations may be used with the present invention without limitation.

Figure 1:
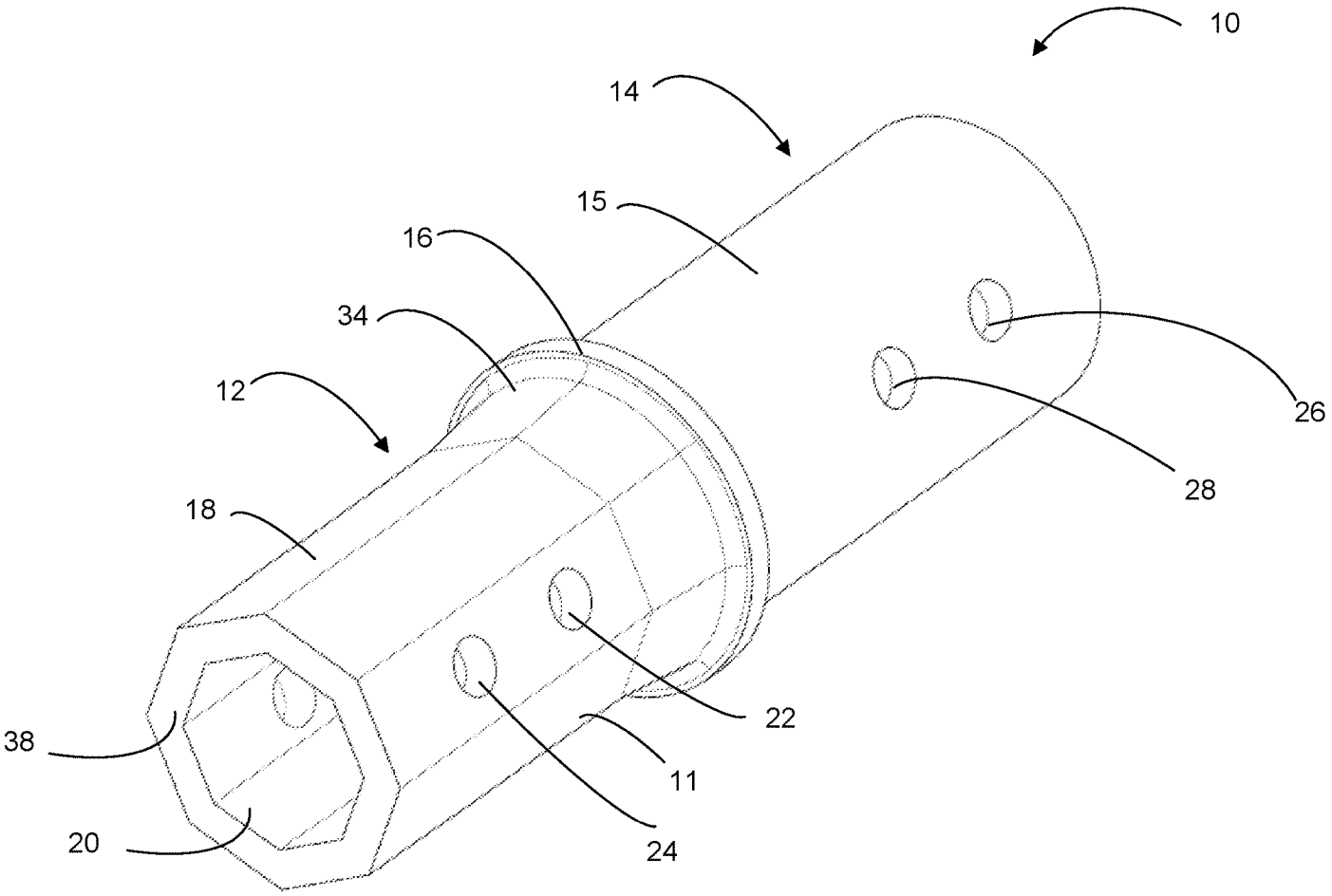
FIG. 1 is a perspective view of an exemplary delineator mounting system in accordance with a first preferred embodiment of the present invention.

With reference now to FIG. 1, a perspective view of an exemplary delineator mounting system 10 in accordance with a first preferred embodiment of the present invention shall now be discussed. As shown, the delineator mounting system 10 preferably includes an extended central housing which includes a lower end 12 and an upper end 14 which are connected at a central flange 16. As shown, the lower end 12 preferably further includes a main body 11 including an octagonal outer surface 18, an octagonal inner surface 20 and a flat end surface 38. Still further, the lower end preferably further includes a group of bolt holes 22, 24 which are preferably sized and spaced to allow a securing bolt (not shown) to extend through the lower end 12 as discussed further with respect to FIG. 7 below. Still further, the lower end 12 preferably further includes a flared lower connecting surface 34 which preferably extends between the main body 11 of the lower end 12 and the central flange 16.

As further shown in FIG. 1, the upper end 14 of the mounting system 10 preferably includes a cylindrical main body 15 which includes upper end bolt holes 26, 28 to secure a delineator pylon (not shown) as discussed in FIG. 7 below.

Figure 2:
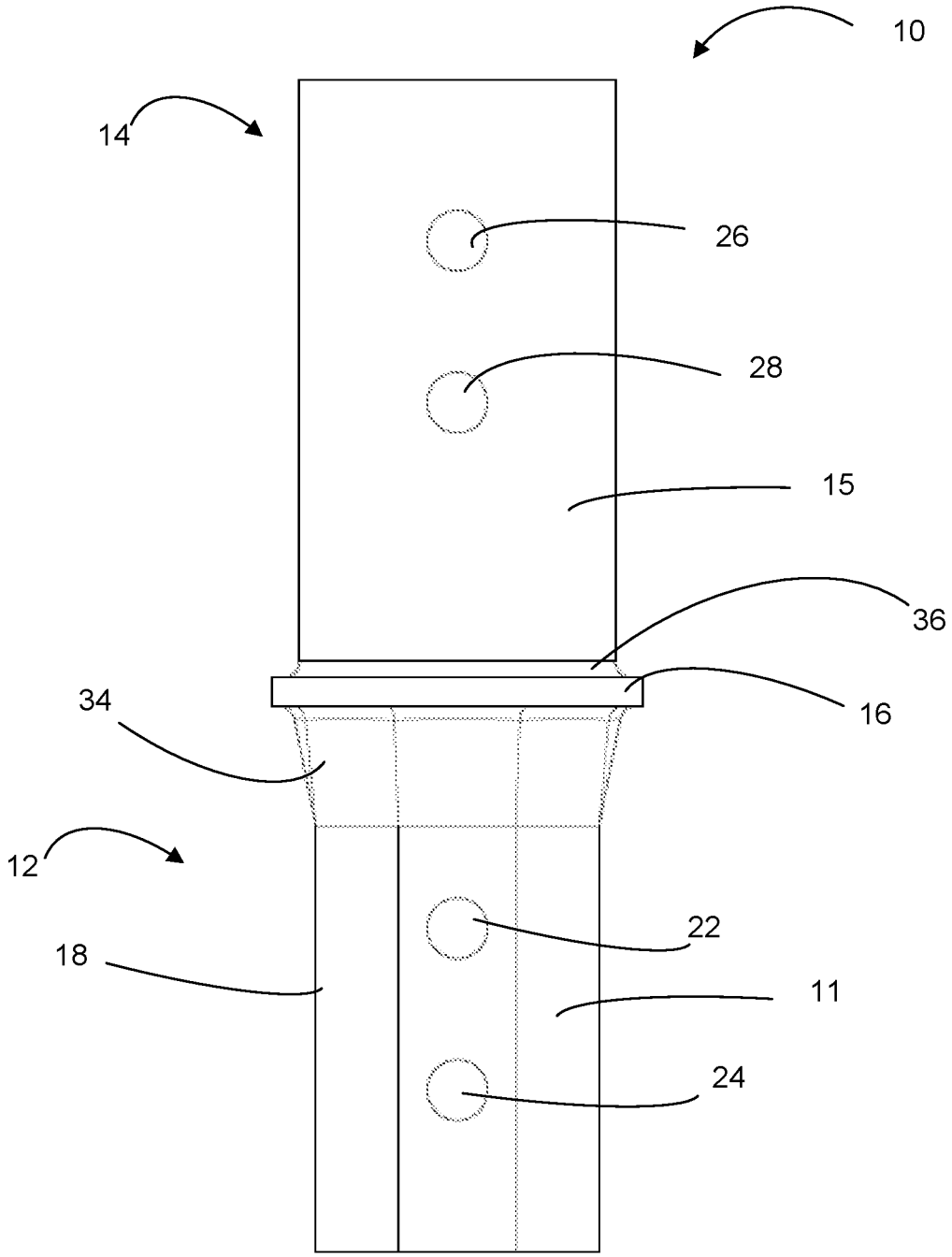
FIG. 2 is a left side elevation view of the exemplary delineator mounting system shown in FIG. 1.
Figure 3:
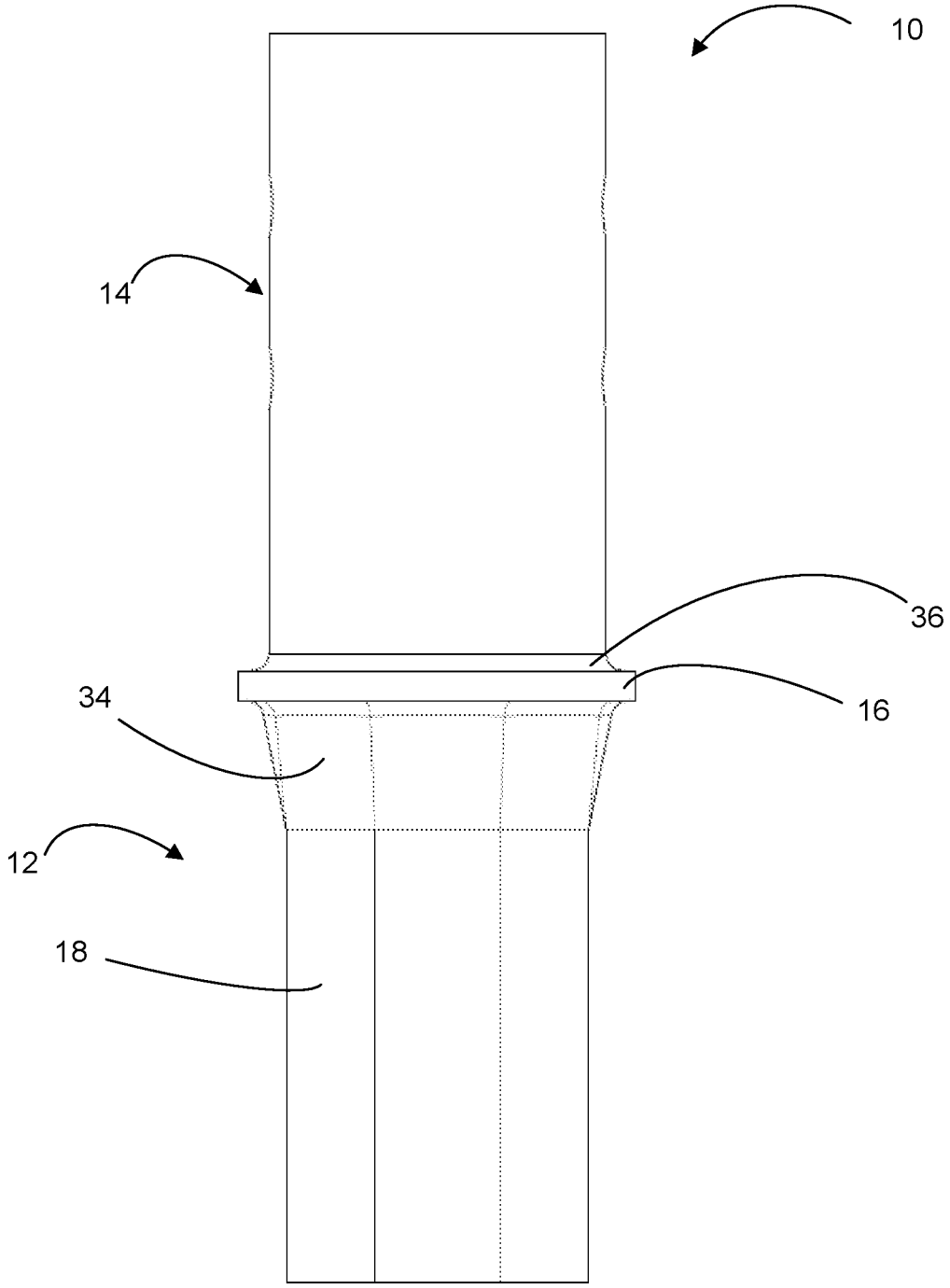
FIG. 3 is a front elevation view of the exemplary delineator mounting system shown in FIG. 2.

With reference now to FIGS. 2 and 3, front and side elevation views of the exemplary delineator mounting system 10 shown in FIG. 1 shall now be further discussed. As shown in FIGS. 2 and 3 and as discussed above, the lower and upper ends 12, 14 are preferably connected at a central flange 16. As further shown, the lower end 12 preferably includes a main body 11 having an octagonal outer surface 18. Still further, the lower and upper ends 12, 14 preferably include lower bolt holes 22, 24 and upper bolt holes 26, 28 respectively. Additionally, the lower end 12 preferably further includes a flared lower connecting surface 34 which extends between the main body 11 of the lower end 12 and the central flange 16. Still further, the upper end 14 preferably includes a flared upper surface 36 which connects the cylindrical main body 15 of the upper end 14 to the central flange 16.

Figure 4:
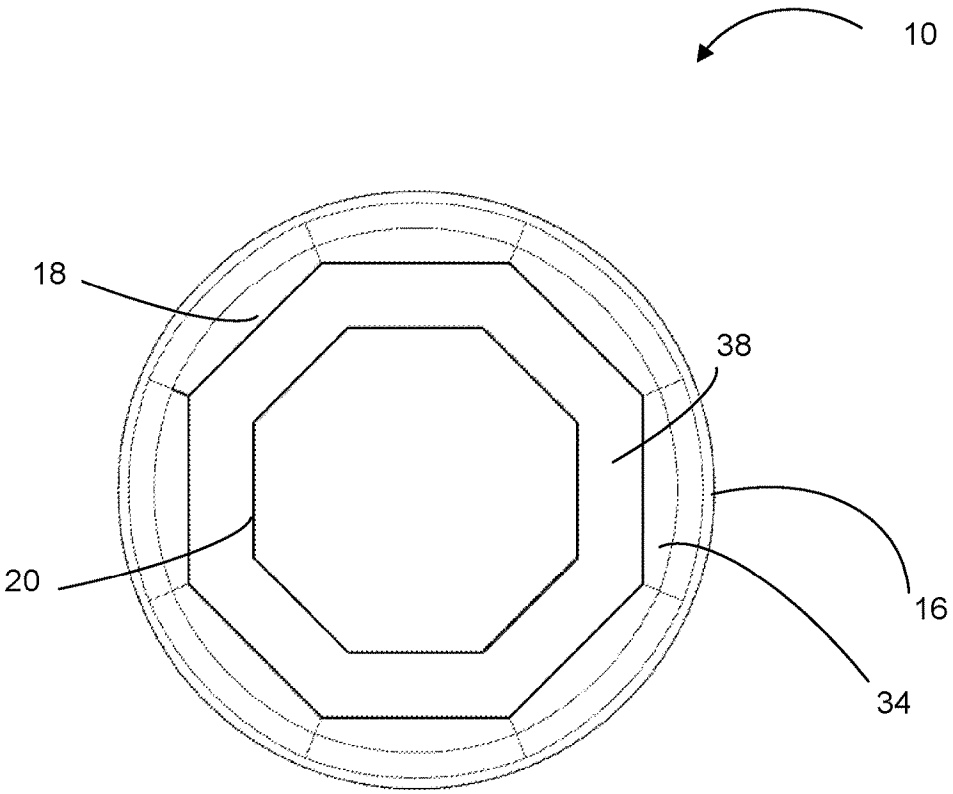
FIG. 4 is a bottom view of the exemplary delineator mounting system shown in FIG. 1.

With reference now to FIG. 4, a bottom view of the exemplary delineator mounting system 10 shown in FIG. 1 shall now be further discussed. As shown, the lower end 12 of the mounting system 10 preferably includes a flat lower surface 38 which is positioned between an octagonal outer surface 18 and an octagonal inner surface 20. Further, the flared lower connecting surface 34 is shown connecting with the central flange 16.

Figure 5:
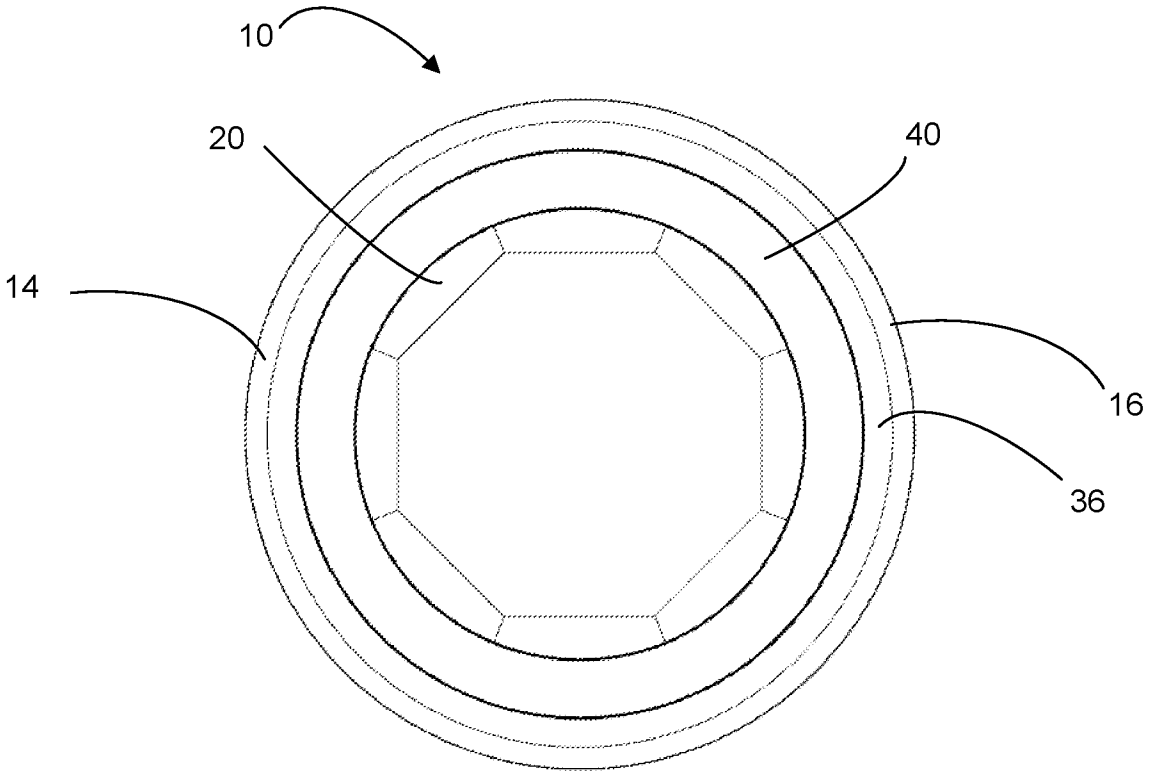
FIG. 5 is a top view of the exemplary delineator mounting system shown in FIG. 1.

With reference now to FIG. 5, a top view of the exemplary delineator mounting system 10 shown in FIG. 1 shall now be discussed. As shown in FIG. 5, the upper end 14 of the delineator mounting system 10 preferably includes a flat top surface 40 and a flared upper connecting surface 36 which connects to the central flange 16. Further, the octagonal inner surface 20 of the lower end 12 is shown. According to alternative embodiments, the mounting system 10 may be filled or may be substantially hollow as shown.

Figure 6:
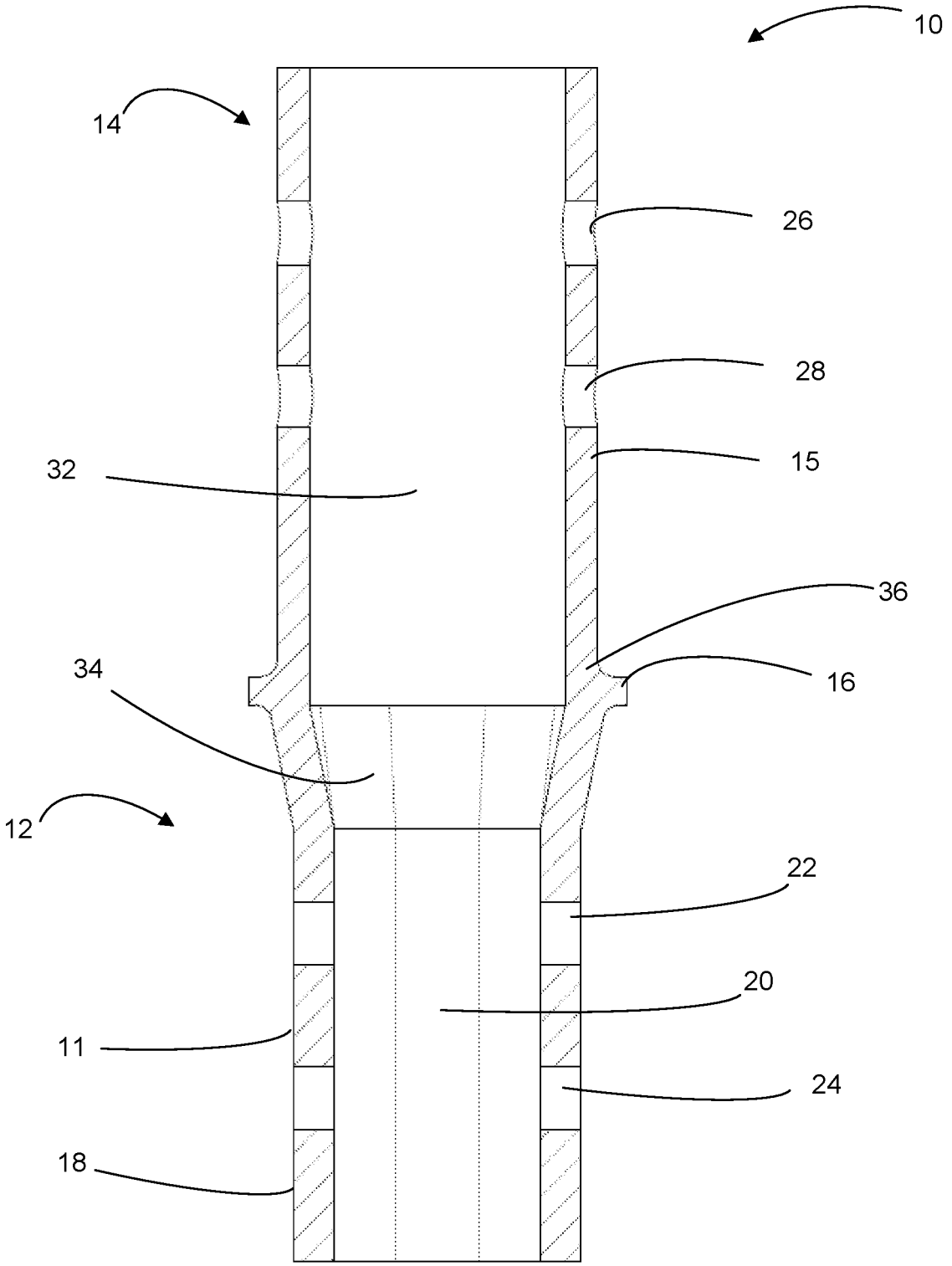
FIG. 6 is a cut-away side view of the exemplary delineator mounting system shown in FIG. 1.

FIG. 6 is a cut-away side view of the exemplary delineator mounting system 10 shown in FIGS. 1-5. As discussed above, the lower and upper ends 12, 14 are preferably connected at a central flange 16. As further shown, the lower end 12 preferably includes a main body 11 having an octagonal outer surface 18 and an octagonal inner surface 20 with lower bolt holes 22, 24 extending therethrough. The lower end 12 preferably further includes a flared lower connected surface 34 as discussed above. As further shown in FIG. 6 and as discussed above, the upper end 14 preferably includes a flared upper surface 36 which preferably connects the cylindrical main body 15 to the central flange 16. As further shown, the upper end 14 preferably further includes a cylindrical interior surface 32 with upper bolt holes 26, 28 extending therethrough.

Figure 7:
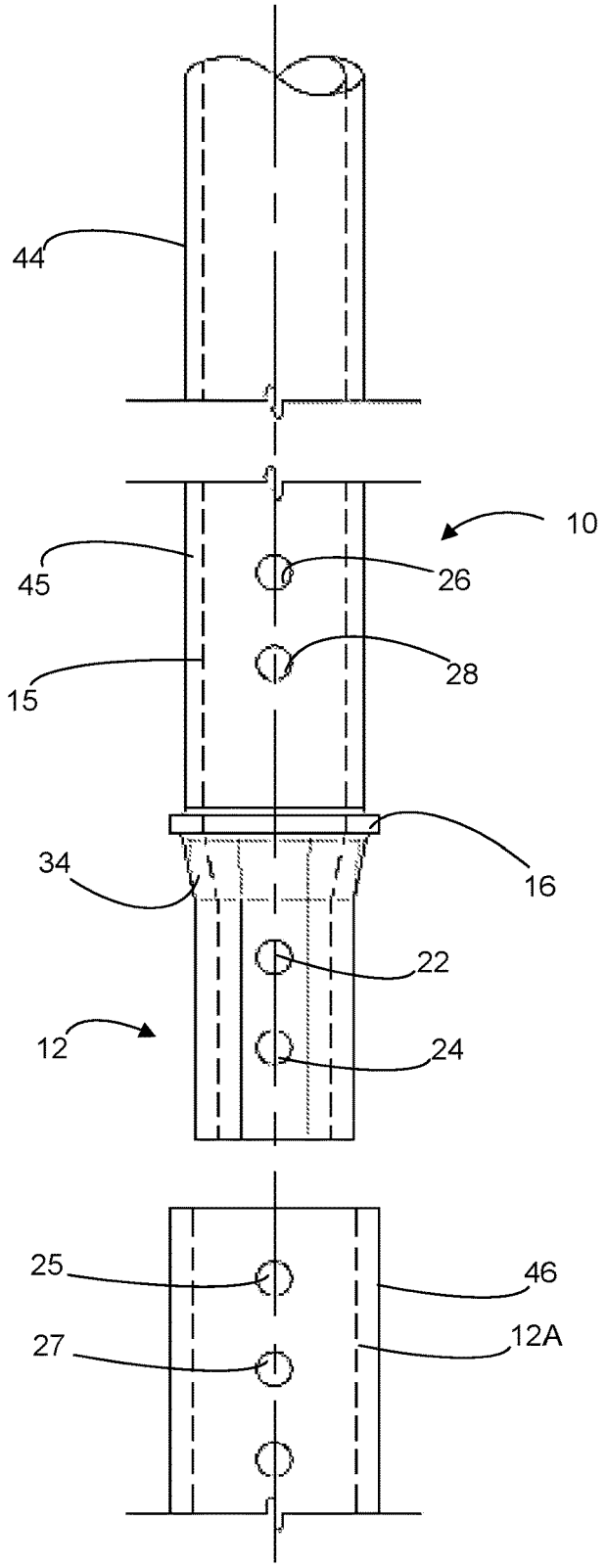
FIG. 7 is front view of an exemplary partially assembled delineator mounting system including a mounting pole and a delineator pylon in accordance with aspects of the present invention.

With reference now to FIG. 7, a front view of an exemplary assembled delineator mounting system 10 including a mounting pole 46 and a delineator pylon 44 is provided. As shown in FIG. 7, the mounting pole 46 of the present invention is preferably a hollow tube attached to a ground surface. According to alternative preferred embodiments, the mounting pole 46 may preferably have a top opening which may preferably be octagonal in circumference. Still further, the mounting pole 46 may preferably include bolt holes 25, 27. According to alternative preferred embodiments, the mounting pole 46 may alternatively have a top opening which is circular, square or rectangular without limitation.

As further shown in FIG. 7, the lower end 12 of the mounting system 10 may preferably be inserted into the mounting pole 46 to the position indicated as 12A. In this position, the bolt holes 22, 24 of the lower end 12 preferably align with the bolt holes 25, 27 of the mounting pole so that securing bolts (not shown) may extend through both the lower end 12 and the mounting pole 46.

As further shown in FIG. 7, the delineator pylon 44 preferably includes a hollow lower end 45 which preferably includes one or more bolt holes (not shown). Preferably, the upper end cylindrical main body 15 is inserted within the hollow lower end 45 of the delineator 44. Alternatively, the hollow lower end 45 could be inserted within the cylindrical main body 15 such as when lower diameter delineator is used. Preferably, the lower end 45 of the delineator 44 may include one or more bolt holes (not shown) which may preferably align with the bolt holes 26, 28 of upper end cylindrical main body 15. Alternatively, the lower end 45 of the delineator 44 may include male/female threads which may mate with female/male threads of the cylindrical main body 15 so that securing bolts (not shown) are not needed.

Figure 8:
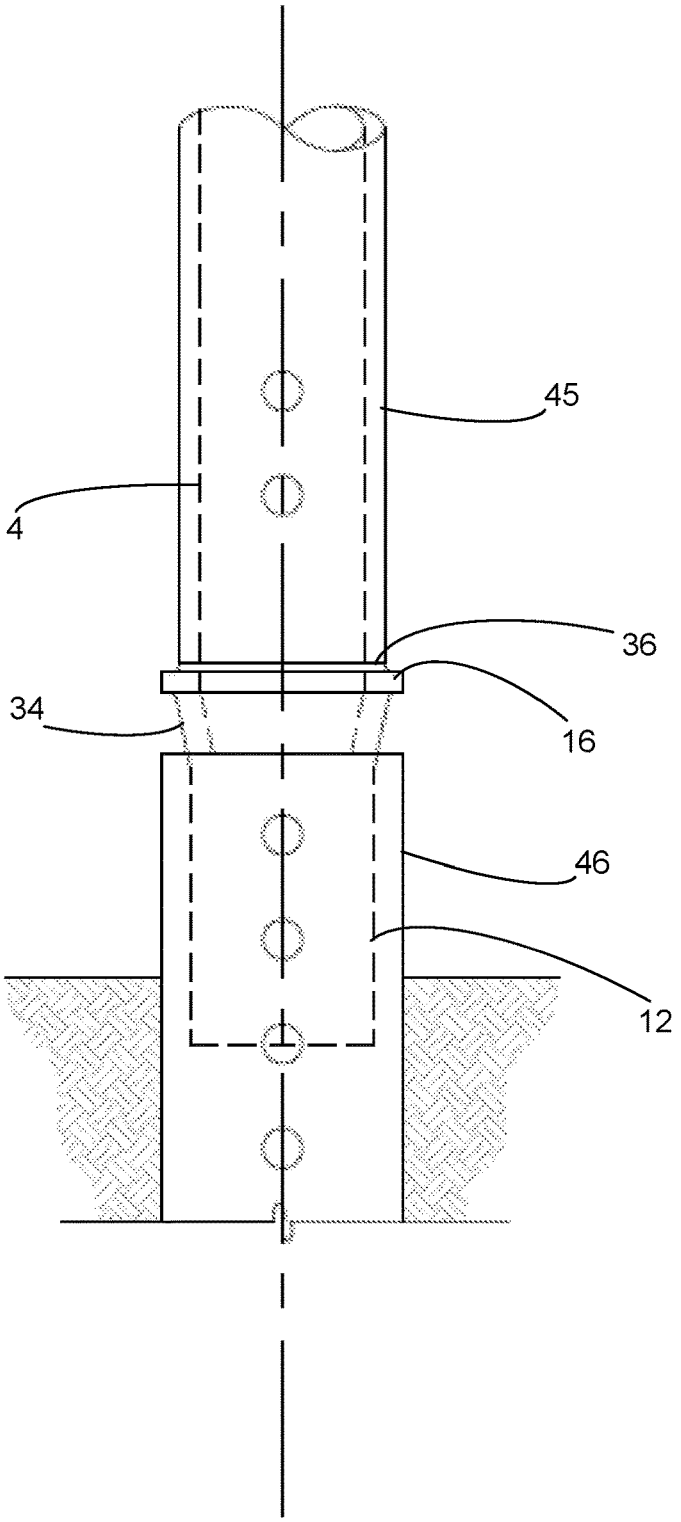
FIG. 8 is front view of an exemplary fully assembled delineator mounting system including a mounting pole and a delineator pylon in accordance with aspects of the present invention.

Referring now to FIG. 8, the lower end 12 preferably may be insertable within the mounting pole 46 to a depth where the flared lower connecting surface 34 and/or the central flange 16 contacts the mounting pole 46. Similarly, the upper end 14 of the mounting system 10 preferably may be inserted into the lower end 45 of the delineator 44 to a depth where the flared upper connecting surface 36 and/or the central flange 16 contacts the delineator 44.

While the invention has been illustrated and described as embodied in a particular delineator mounting system, it is not intended to be limited to the details shown, since it will be understood that various omissions, modifications, substitutions and changes in the forms and details of the device illustrated and in its operation can be made by those skilled in the art without departing in any way from the spirit of the present invention.

The scope of the present invention should be determined not by the embodiments illustrated, but by the appended claims and their legal equivalents.

What is claimed is:

1. A delineator mounting system, wherein the system comprises:

a mounting section, wherein the mounting section comprises a cylindrical main body; wherein the cylindrical main body is comprised of a hollow cylinder comprised of a mounting section exterior surface and a mounting section interior surface; wherein the mounting section comprises an outer cylindrical wall having a first outer circumference and a second inner circumference; wherein the mounting section comprises a mounting section upper end and a mounting section lower end;

a central flange section, wherein the central flange section is comprised of a central flange ring; wherein the central flange ring has a ring inner circumference and a ring outer circumference; wherein the ring outer circumference is greater than the first outer circumference of the mounting section; wherein the central flange section is attached to the mounting section lower end; and an insertion section, wherein the insertion section comprises an insertion section upper end and an insertion section lower end; wherein the insertion section upper end is attached to the central flange section; wherein the insertion section lower end comprises an octagonal outer surface and an octagonal inner surface;

wherein the insertion section upper end comprises a cylindrically flared outer wall; wherein the cylindrically flared outer wall extends out to a flared wall maximum circumference; wherein the ring outer circumference is greater than the flared wall maximum circumference.

2. The system of claim 1, wherein the system further comprises a delineator; wherein the delineator is comprised of a hollow cylindrical tube having a delineator upper end and a delineator lower end; wherein the delineator lower end comprises a delineator lower surface.

3. The system of claim 2, wherein the system further comprises a mounting tube, wherein the mounting tube is secured to a road surface; further wherein the mounting tube is comprised of a hollow tube have an octagonal inner surface and an open upper end having a mounting tube upper end surface.

4. The system of claim 3, wherein the insertion section lower end is inserted within the mounting tube to a depth where the central flange ring is proximate to the mounting tube upper end surface.

5. The system of claim 4, wherein the delineator lower end is inserted within the mounting tube to a depth where the central flange is proximate to the delineator lower surface.

6. The system of claim 1, wherein the mounting section comprises a plurality of mounting section bolt holes which extend through the mounting section exterior surface and the mounting section interior surface.

7. The system of claim 6, wherein the insertion section lower end comprises a plurality of insertion section bolt holes which extend through the octagonal outer surface and the octagonal inner surface.

* * * * *